US006336321B1

(12) United States Patent
Sagara et al.

(10) Patent No.: US 6,336,321 B1
(45) Date of Patent: Jan. 8, 2002

(54) ENGINE EXHAUST ASSEMBLY FOR A MOTORCYCLE

(75) Inventors: Mikio Sagara; Noritoshi Iwase; Kazuo Yamamoto; Masakazu Kadota; Hideo Koide; Yoshiaki Nakashima; Shinji Goto; Hiroaki Tsukui; Osamu Bunya, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/488,795

(22) Filed: Jan. 21, 2000

(30) Foreign Application Priority Data

Jan. 22, 1999 (JP) ..... 11-014903

(51) Int. Cl.[7] ..... F01N 7/00
(52) U.S. Cl. ..... 60/324; 180/309; 60/686
(58) Field of Search ..... 60/324, 272, 685, 60/686; 180/309, 219

(56) References Cited

U.S. PATENT DOCUMENTS 3,523,418 A * 8/1970 Marsee
3,751,921 A * 8/1973 Blomberg et al.
4,785,626 A * 11/1988 Shiraishi
4,795,420 A * 1/1989 Sakurai et al.
6,220,907 B1 * 4/2001 Shimizu

FOREIGN PATENT DOCUMENTS

JP U222617 2/1990
JP A10238334 9/1998

* cited by examiner

*Primary Examiner*—Kevin Hurley
(74) *Attorney, Agent, or Firm*—Birch, Stewart, Kolasch & Birch, LLP

(57) ABSTRACT

A partitioning member for dividing a connecting pipe into at least two exhaust passageways is provided in the connecting pipe, which is attached to an exhaust side of a silencer. A valve mechanism is operable to vary the passageway area of one of the exhaust passageways. With this structure, for example, when an engine is rotating at low revs, exhaust gas is discharged from the exhaust passageway without the valve mechanism, while when the engine is rotating at high revs exhaust gas is simultaneously discharged from the exhaust passageway having no valve mechanism and a passageway provided with the valve mechanism. Therefore, it is possible to reduce exhaust noise when the engine is rotating at low revs.

8 Claims, 7 Drawing Sheets

ENGINE EXHAUST ASSEMBLY FOR A MOTORCYCLE

BACKGROUND OF THE INVENTION

1. Field of the Invention

The present invention relates to improvements to an engine exhaust assembly. In particular, the present invention relates to an engine exhaust assembly for a motorcycle.

2. Description of Related Art

Engine exhaust assemblies for motorcycles are known, for example, from (1) Japanese Patent Laid-open No. Hei. 10-238334, entitled 4-cycle engine, and (2) Japanese Utility Model Laid-open No. Hei. 2-22617, entitled Engine Exhaust Assembly.

In the above mentioned document (1) according to FIG. 1 and FIG. 2 of that publication, an exhaust pipe 40 is connected to an exhaust passageway 14 of a cylinder head 4. Furthermore, a variable valve 41 having a cutaway section 4 la is provided in the exhaust passageway side of the exhaust pipe 40.

In the above described document (2) according to FIG. 2 of that publication, the exhaust system is branched into two exhaust systems, with first and second exhaust outlet pipes 5 and 6 being respectively provided in the exhaust systems. Furthermore, an opening and closing valve 7 is provided in the first exhaust outlet pipe 5 of the respective exhaust systems. The opening and closing valves 7, 7 of the respective exhaust systems are closed when the engine is rotating at low revs, one of the opening and closing valves 7 is closed when the engine is rotating at medium revs, and the opening and closing valves of the respective exhaust systems are open when the engine is rotating at high revs. In this way, it is intended to reduce the sound pressure level of exhaust noise.

However, in the above-described document (1), a variable valve 41 is provided in an inlet of the exhaust pipe 40, which means that it is not possible to adequately reduce the sound pressure level of the exhaust noise.

Also, in the above-described document (2), the exhaust system is divided into two. A first exhaust outlet pipe 5 and a second exhaust outlet pipe 6 are provided in each of the exhaust systems, and an opening and closing valve 7 is respectively fitted in the first exhaust outlet pipe of each exhaust systems, which means that the structure is made complicated and costs also increase.

SUMMARY OF THE INVENTION

Therefore, the object of the present invention is to provide an engine exhaust assembly for a motorcycle having a simple structure, and which can sufficiently reduce acoustic noise.

In order to achieve the above described object, a first aspect of the present invention has a partitioning member provided in a pipe of a silencer arranged in the engine exhaust assembly for dividing the pipe into at least two exhaust passageways. The partitioning member is provided with a valve mechanism for causing variation in surface area of one of the exhaust passages.

For example, when the engine is rotating at low revs, the valve mechanism is closed, so that exhaust gas is discharged from the exhaust passageway without the valve mechanism. Furthermore, when the engine is rotating at high revs the valve mechanism is open so exhaust gas is discharged simultaneously from the exhaust passageway without the valve mechanism and the exhaust passageway provided with the valve mechanism. Therefore, it is expected that the exhaust noise when the engine is rotating at low revs will be reduced.

Also, by dividing one connecting pipe with a partitioning member and providing a valve mechanism in one of the exhaust passageways formed by the dividing member, the structure of the exhaust assembly is simplified.

A second aspect of the present invention is an engine exhaust assembly, having a valve mechanism for varying opening areas of a connecting pipe for a silencer arranged in the engine exhaust assembly. The valve mechanism is fitted into the connecting pipe of the silencer. One end of a connecting member connects to the valve mechanism, the other end of the connecting member connects to drive means arranged outside the silencer. Furthermore, the valve mechanism is driven by the drive means and the connecting member passes through the silencer.

The valve mechanism is fitted into the connecting pipe of the silencer, one end of a connecting member is connected to the valve mechanism, the other end of the connecting member is connected to drive means arranged outside the silencer, and the valve mechanism is driven by the drive means. Accordingly, by fitting a pipe to the silencer and housing part of the connecting member in the pipe, the connecting member is hidden from the outside of the silencer and the external appearance of the exhaust assembly is improved.

A third aspect of the present invention is a motorcycle exhaust assembly having an engine arranged substantially in the center of a vehicle frame of the motorcycle. An exhaust pipe extending rearwards from the engine, a silencer is connected to the exhaust pipe and a valve mechanism is provided in a connection pipe of the silencer. One end of a connecting member is connected to the valve assembly, the other end of the connecting member is connected to drive means provided on the side of a vehicle frame, and the valve mechanism is driven by the drive means. Furthermore, a central potions of the connecting member is close to the silencer, and is caused to run alongside a member extending out from the vehicle frame.

The valve mechanism is fitted into the silencer, the drive means is attached to the side of the vehicle frame, and the valve mechanism is operated by connecting the valve mechanism to the drive means using the connecting member. The connecting member is close to the silencer, and is caused to run alongside a member extending out from the vehicle frame so that it reaches the side of the vehicle frame. Therefore, a member for supporting the connecting member is omitted and the number of components is reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Embodiments of the present invention will now be described with reference to the accompanying drawings. The directions front, rear, left, right, up and down refer to directions as viewed from the point of view of the rider, while Fr represents front side, Rr represents rear side, L represents left side and R represents right side.

Figure 1:
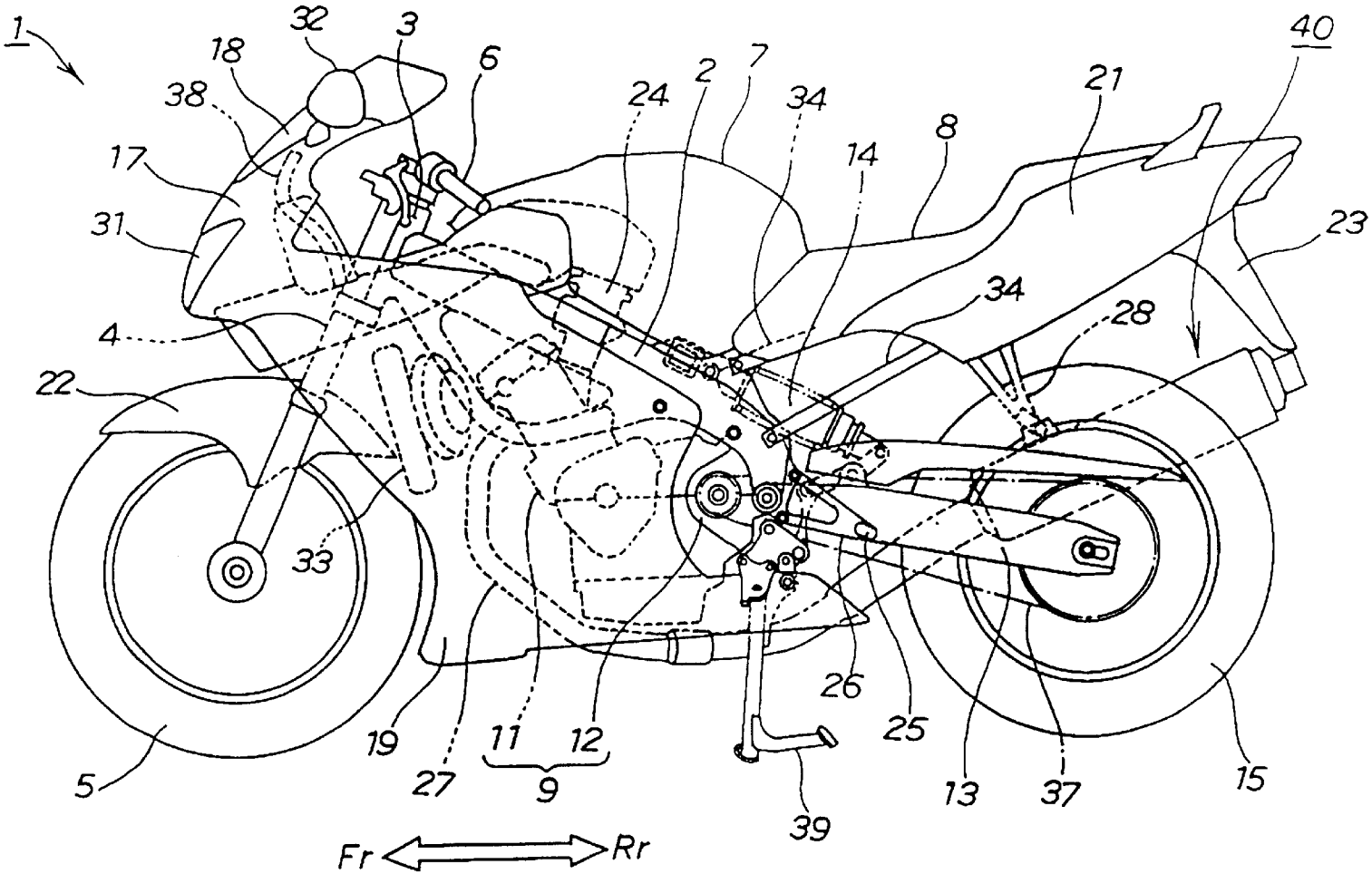
FIG. 1 is a side view of a motorcycle to which an engine exhaust assembly of a first embodiment of the present invention is attached.

FIG. 1 is a side view of a motorcycle to which an engine exhaust assembly of a first embodiment of the present invention is attached. The motorcycle 1 comprises a vehicle frame 2, a front fork 4 to which a head pipe 3 of the vehicle frame 2 is attached, a front wheel 5 attached to the front fork 4, a handlebar 6 connected to the front fork 4, a fuel tank 7 attached so as to straddle an upper front section of the vehicle frame 2, a seat 8 attached to an upper rear section of the vehicle frame 2, a power unit 9 (a structure comprising a combination of an engine 11 to the front and a transmission 12 to the rear) attached to a lower front section of the vehicle frame 2, a swing arm 13 attached to a lower rear section of the vehicle frame 2, rear suspension 14 suspended between a midpoint of the swing arm 13 and the vehicle frame 2, a rear wheel 15 attached to a rear end of the swing arm 13, and an exhaust assembly 40 as an engine exhaust assembly or a motorcycle exhaust assembly extending from the engine 11 to the rear of the vehicle frame 2.

Reference numeral 24 is a carburetor, reference numeral 25 is a step holder, reference numeral 26 is step holder stay close to the carburetor 26 and extending out from the vehicle frame, reference numeral 27 is a exhaust pipe, reference numeral 28 is a muffler stay close to the silencer and extending out from the vehicle frame, reference numeral 31 is a headlamp, reference numeral 32 is a mirror, reference numeral 33 is a radiator, reference numerals 34, 34 are seat rails, reference numeral 37 is a drive chain, reference numeral 38 is a cowl stay, and reference numeral 39 is a main stand.

Specifically, the motorcycle 1 is a full cowling type motorcycle having a good external appearance, provided with an upper cowl 17 covering an upper front section of the vehicle frame, a windscreen 18 attached to an upper part of the upper cowl 17, a side cowl 19 covering a side section of the vehicle frame 2, a seat cowl 21 covering below a seat 8 to the rear of the vehicle frame 2, a front mudguard 22 covering the top of the front wheel 5, and a rear mudguard 23 covering the rear and top of the rear wheel 15.

Figure 2:
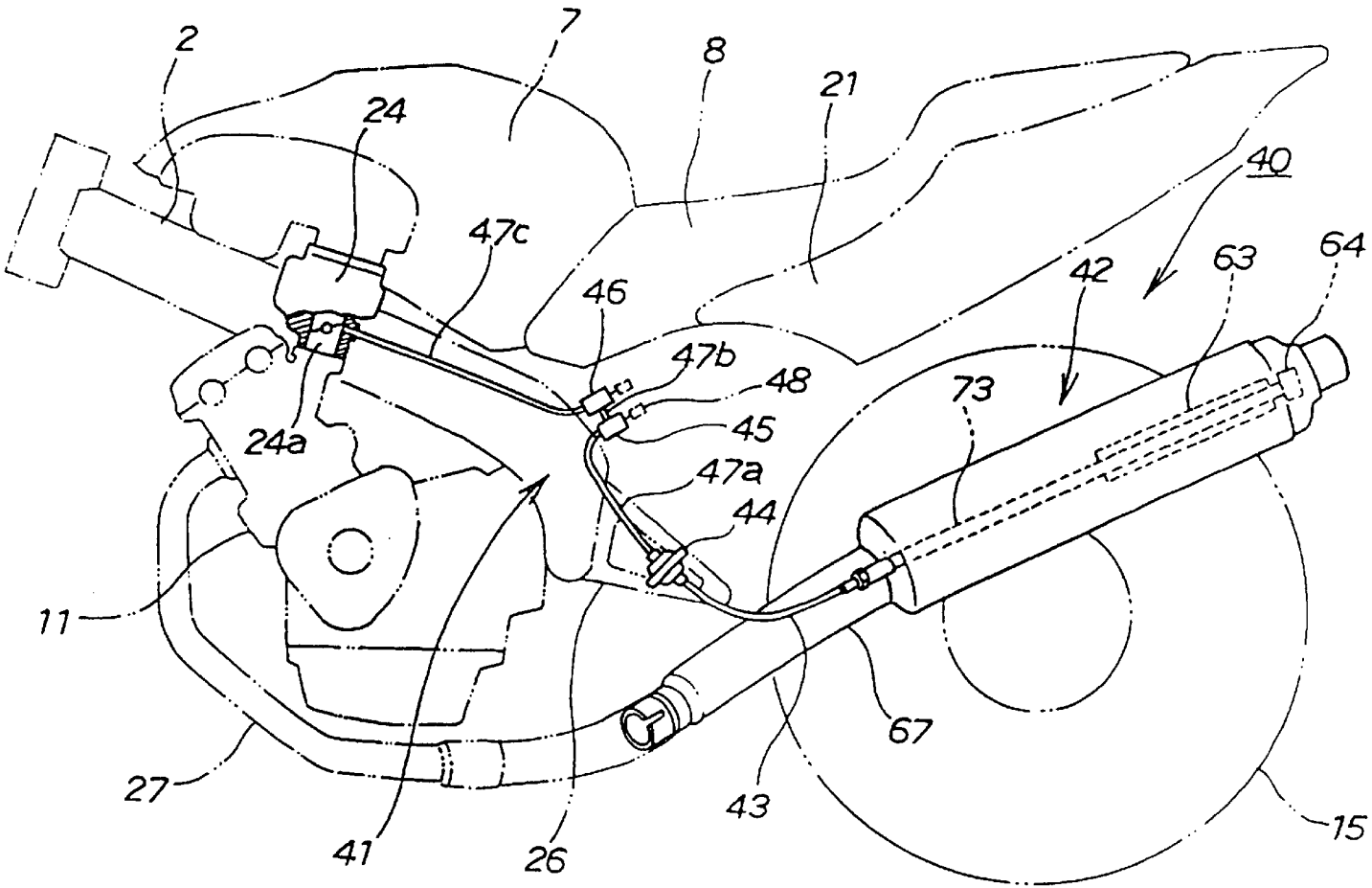
FIG. 2 is a side view of the engine exhaust assembly of a first embodiment of the present invention.

FIG. 2 is a side view of the engine exhaust assembly of a first embodiment of the present invention. The exhaust assembly 40 in an exhaust assembly of an engine 11, has a partitioning member 77 (described later) provided in a pipe 63 of a silencer 42 for dividing the pipe 63 into at least two exhaust passageways 75, 76 (described later), and provided with a valve mechanism 64 for causing variation in a surface area of one of the exhaust passages 75 and 76. For example, when the engine 11 is rotating at low revs, by closing the valve mechanism 64 and discharging exhaust gas from the exhaust passageway 75, 76 without the valve mechanism 64, the exhaust noise when the engine is rotating at low revs can be reduced. Furthermore, drive means 41 is attached to the side of the vehicle frame 2, the silencer 42 is attached to the end of the exhaust pipe 27, and a connecting member 43 for joining the valve mechanism 64 of the silencer 42 to the drive means 41 is also provided.

In more detail, the drive means 41 is joined to one side of a diaphragm 44 by the connecting member 43, and is connected at the other end to a throttle valve chamber 24a of carburetor 24 through a bypass controller 45 and a check valve 46. The drive means drives the diaphragm by applying negative pressure of the throttle valve chamber 24a to the other end of the diaphragm 44. Reference numeral 47*a* is an air hose joining the diaphragm 44 and bypass controller 45, reference numeral 47*b* is an air hose joining the bypass controller and the check valve 46, and reference numeral 47*c* is an air hose joining the check valve 46 and the throttle valve chamber 24*a*.

The bypass controller 45 controls the amount of negative pressure applied from the throttle valve chamber 24*a* to the diaphragm 44 using information from a spark unit (ignition coil) 48, and causes a reduction in negative pressure bypass amount when the engine 11 (refer to FIG. 1) is rotating at low revs and increases the amount of negative pressure applied to the diaphragm 44, but causes an increase in bypass amount when the engine 1 is rotating at high revs to reduce the amount of negative pressure applied to the diaphragm 44.

The check valve 46 is a valve for setting the amount of negative pressure to be applied from the throttle valve chamber 24*a* to the diaphragm 44 in a predetermined range. The drive means 41 uses negative pressure of the throttle valve chamber 24*a* as a drive source, enabling the exhaust assembly 40 to have a simple structure.

Figure 3:
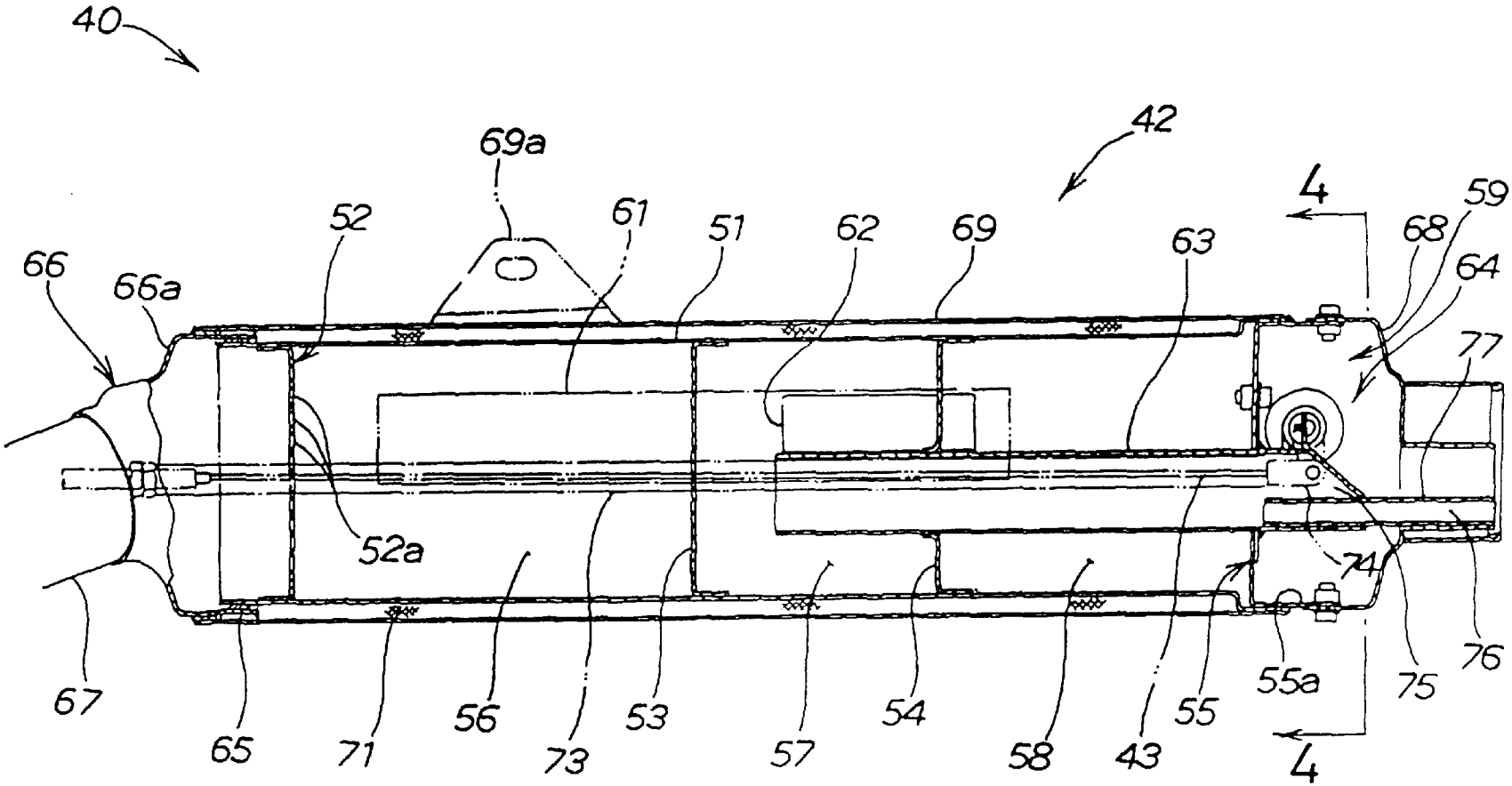
FIG. 3 is front cross sectional view of a silencer of the engine exhaust assembly of the first embodiment of the present invention.

The silencer 42 will now be described in detail with reference to FIG. 3. FIG. 3 is front cross sectional view of a silencer of the engine exhaust assembly of the first embodiment of the present invention. The silencer 42 has an attenuation wall 52, a front partitioning wall 53, a rear partitioning wall 54 and an outlet wall 55 attached in that order from an inlet side inside an inner wall tube 51. A first expansion chamber 56 is formed by the attenuation wall 52, the front partitioning wall 53 and the inner wall tube 51. A second expansion chamber 57 is formed by the front partitioning wall 53, the rear partitioning wall 54 and the inner wall tube 51. A third expansion chamber 58 is formed by the rear partitioning wall 54 the outlet wall 55 and the inner wall tube 51. The first expansion chamber 56 and the third expansion chamber 58 are joined by an exhaust inlet pipe 61. The third expansion chamber 58 and the expansion chamber 57 are joined by a connecting pipe 62. Furthermore, the second expansion chamber 57 is released to the outside through a connecting pipe 63. A switching unit 59 is attached to an exhaust side of the connecting pipe 63 via a gasket 63*a*. An extension pipe 66 and a connecting pipe 67 are attached in that order to the outside of the inlet side of the inner wall tube 51 via an intermediary pipe 65. Furthermore, a tail cover 68 is attached to a circular section 55*a* of the outlet wall 55. The inner wall tube 51 is covered by an outer wall pipe 69, and a heat insulating material 71 is interposed between the outer wall pipe 69 and the inner wall tube 51. Also, a guide pipe 73 is passed through a tapered section 66*a* of the extension pipe 66, the attenuation wall 52, the front partitioning wall 53, the rear partitioning wall 54 and the outlet wall 55, as a pipe for guiding the connecting member 43.

The outer wall pipe 69 is provided with a support stay 69*a* for attaching the silencer 42 to a muffler stay 28 (refer to FIG. 1), and the attenuation wall 52 is provided with a plurality of holes 52*a* in a plate.

The connecting member 43 is for connecting the valve mechanism 64 to the diaphragm 44, as shown in FIG. 2. One end of the connecting member is provided with a link holder (see FIG. 3) for connecting to the valve mechanism 64. The connecting member 43 is passed through the guide pipe 73 and the other end runs along a step holder stay 26 and is drawn into the side of the vehicle frame 2.

In other words, the exhaust assembly 40 shown in FIG. 2 has an intermediate section of the connecting member 43 housed in a guide pipe 73 provided inside the silencer 42, and runs along a step holder stay 26 (refer to FIG. 2) as a member close to the silencer 42 and extending out from the vehicle frame 2. The connecting member 43 can be hidden from outside of the silencer 42, thus improving the external appearance of the exhaust assembly.

Figure 4:
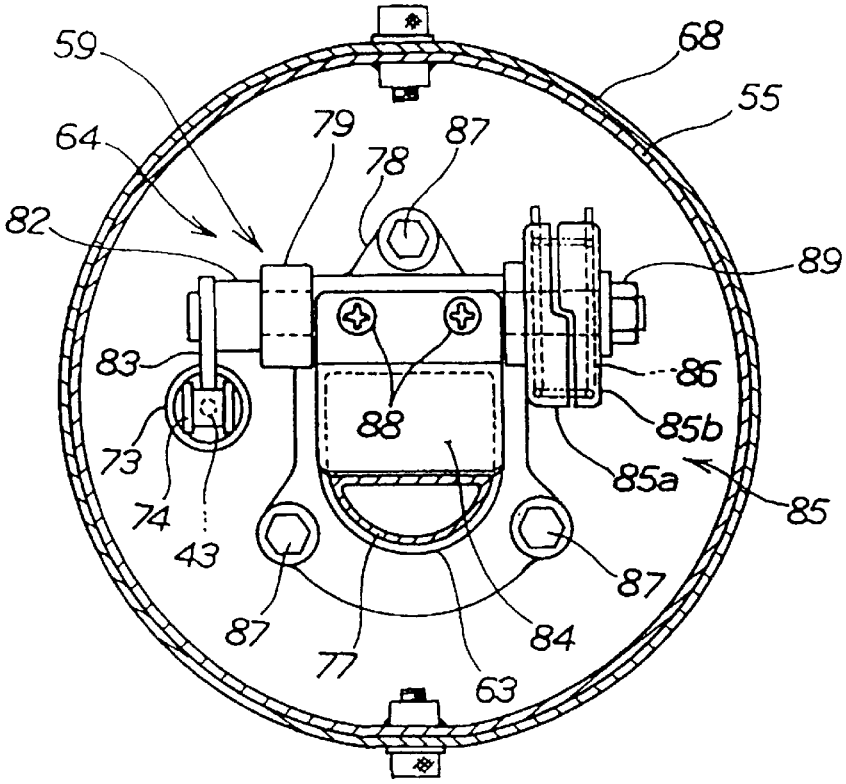
FIG. 4 is a drawing looking in the direction of arrows 4—4 in FIG. 3.
Figure 5:
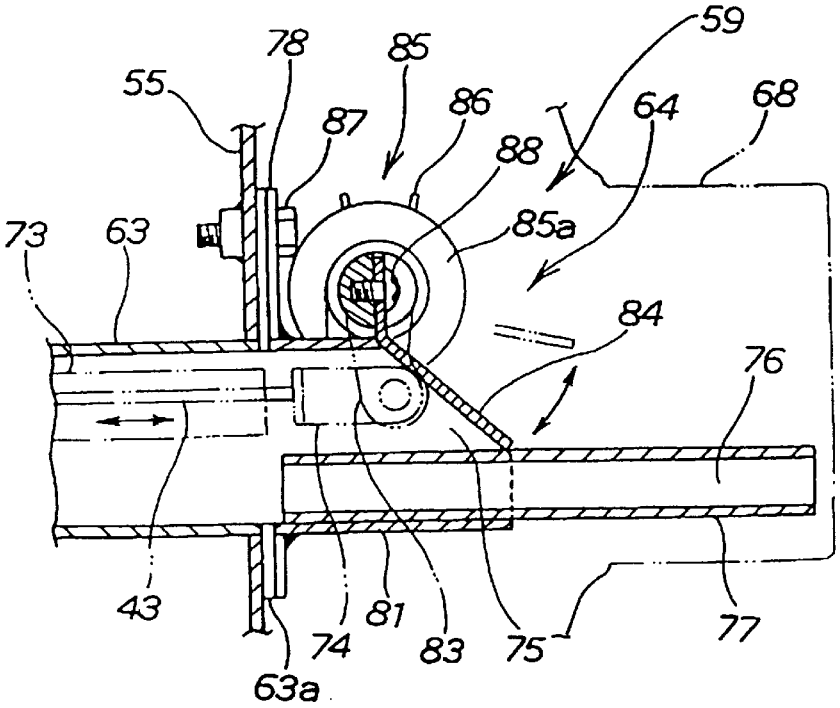
FIG. 5 is a side view of a valve mechanism of the engine exhaust assembly of the first embodiment of the present invention.

Description will now be provided of a switching unit 59 to which the silencer 42 is attached with reference to FIGS. 4 and 5. FIG. 4 is a view in the direction of arrows 4—4 in FIG. 3, and illustrates a rear view of the switching unit 59. FIG. 5 is a side cross sectional view of a switching unit 59 of the engine exhaust assembly of the first embodiment of the present invention.

The switching unit 59 causes variation in the opening area of the connecting pipe 63, and is a mechanism for varying the flow amount of exhaust gas. Specifically, a joint pipe 81 is attached to a support plate 78, a partitioning member 77 is attached to the joint pipe 81, first and second exhaust passageways 75 and 76 are partitioned off as exhaust passageways, and the valve mechanism 64 is attached to the joint pipe 81.

The valve mechanism 64 has a support platform 79 attached to the joint pipe 81, a shaft member 82 is rotatably attached to this support platform 79, a lever 83 for connecting to a connecting holder 74 is attached to one end of the shaft member 82, an opening and closing member 84 is attached to a central section of the shaft member 82, and a return unit 85 for returning the opening and closing member 84 to its initial state is attached to the other end of the shaft member 82.

In more detail, the return unit 85 comprises a fixed receiving section 85*a* attached to the support platform 79 side, a rotating receiving section 85*b* attached to the shaft member 83 side, and a return spring 86 wound over and between the receiving sections 85*a* and 85*b*.

Reference numerals 87 represent bolts attaching the support plate 78 to the outlet wall 55, reference numeral 88 represents a screw for attaching the opening and closing plate 84 to a central section of the shaft member 83, and reference numeral 89 represents a nut holding the shaft member 83 on the support platform 79.

That is, the switching unit 59 is removably attached to the connecting pipe 63, which means that maintenance of the valve mechanism 64 is made easy, and it becomes possible to use the same structure for various mechanisms. Also, by using the same structure for various mechanisms, it is possible to reduce the mass production costs.

Next, the operation of the exhaust assembly 40 described above will be described.

Figure 6:
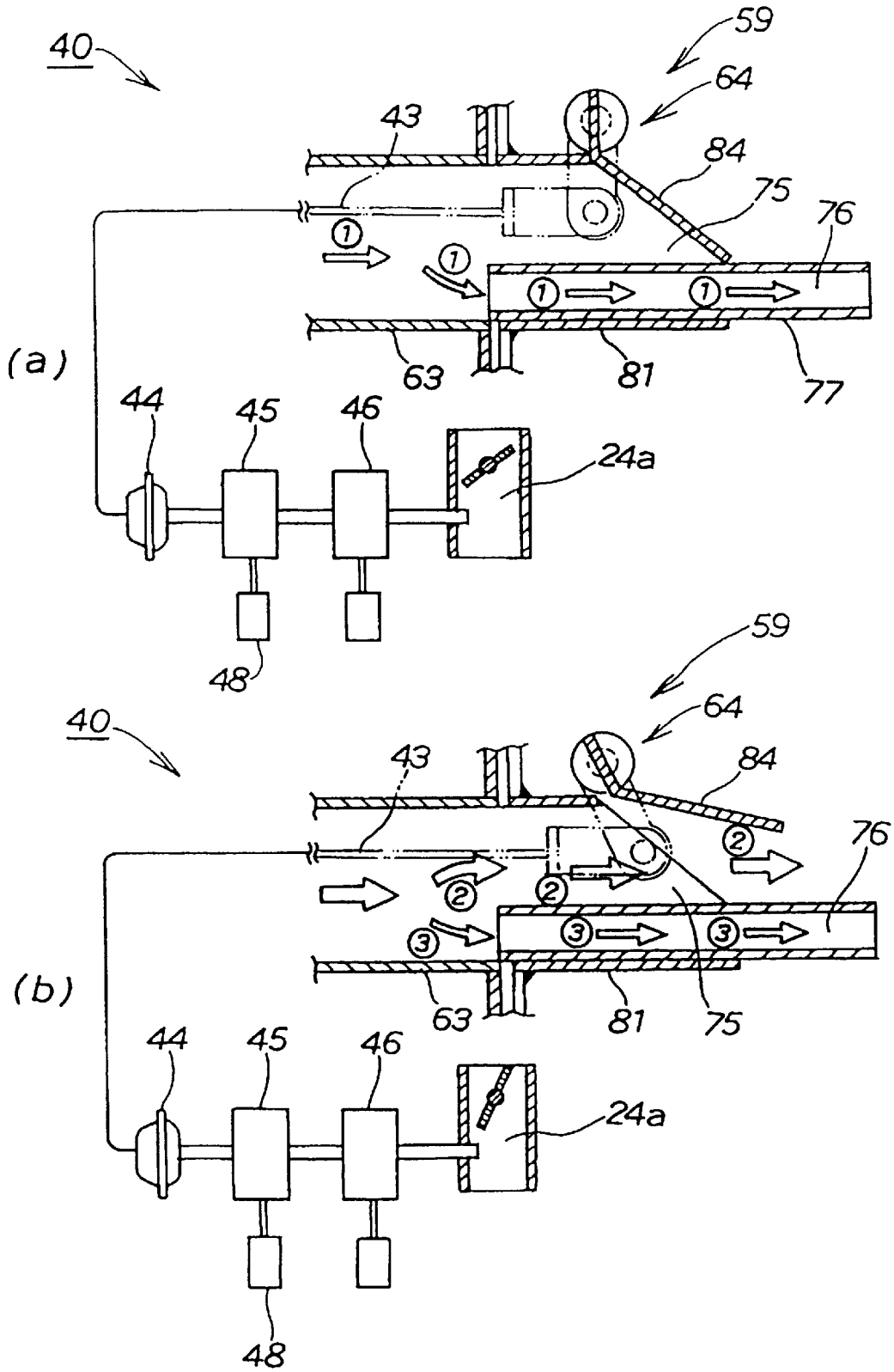
FIG. 6 is a drawing for describing the operation of the engine exhaust assembly of the first embodiment of the present invention.

FIG. 6(*a*) and FIG. 6(*b*) are drawings for describing the operation of the engine exhaust assembly of the first embodiment of the present invention.

In FIG. 6(*a*), when the engine is rotating at low revs, the bypass amount of negative pressure is reduced by the bypass controller 45, and the amount of negative pressure applied to the diaphragm 44 is increased to pull the connecting member 43. The opening and closing plate 84 of the valve mechanism 64 is then closed and the first exhaust passageway 75 is blocked off Exhaust gas is discharged from the exhaust passageway 76 to the outside, as shown by the allows labeled ①.

When the engine is rotating at low revs, there is also less exhaust gas, which means that it is possible to sufficiently discharge exhaust gas with only the second exhaust passageway 76 open. Since the first exhaust passageway 75 is blocked off when the engine is at low revs, it is possible to reduce the exhaust noise.

In FIG. 6(*b*), when the engine is rotating at high revs, the bypass amount of negative pressure is increased by the bypass controller 45, and the amount of negative pressure applied to the diaphragm 44 is reduced to slacken the connecting member 43. The opening and closing plate 84 of the valve mechanism 64 is then open and the first exhaust passageway 75 is released. Exhaust gas is discharged from the first exhaust passageway 75, as shown by the arrows labeled ② and from the second exhaust passageway 76, as shown by the arrows labeled ③ to the outside.

Specifically, when the engine is rotating at high revs, the first exhaust passageway 75 is released, and exhaust gas is discharged from the first and second exhaust passageways 75 and 76 so as not to oppose the engine.

Figure 7:
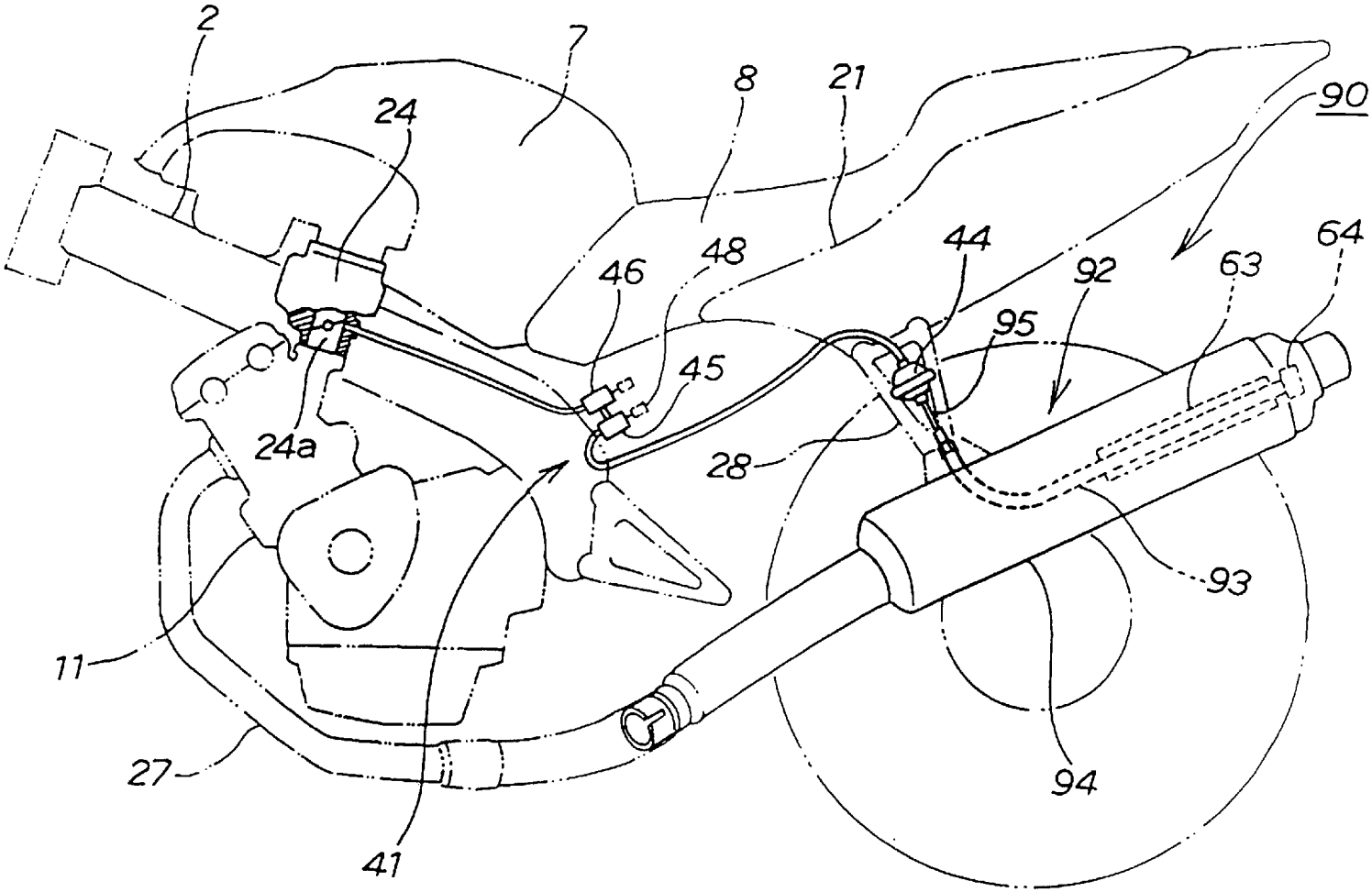
FIG. 7 is a side view of the engine exhaust assembly of a second embodiment of the present invention.

FIG. 7 is a side view of the engine exhaust assembly of a second embodiment of the present invention, and shows an example of a modification to the engine exhaust assembly. Parts that are the same as those in the first embodiment have the same reference numerals, and detailed description will therefore be omitted.

The exhaust assembly 90, as an engine exhaust assembly or motorcycle exhaust assembly, comprises drive means 41 attached to the side of the vehicle frame 2, a silencer 92 attached to the end of an exhaust pipe 27, and a connecting member 95 for linking the valve mechanism 64 of the silencer 92 to the drive means 41.

The silencer 92 has substantially the same structure as the silencer 42 of the exhaust assembly 40 shown in FIG. 2, but a guide pipe 93 is made of a curved pipe, a tip end of the pipe 93 protrudes from a middle section of an outer wall pipe 94, and the connecting member 95 engages with the vehicle frame 2 side drive means 41, via a muffler stay 28 close to the silencer 92 and extending out from the vehicle frame 2.

Figure 8:
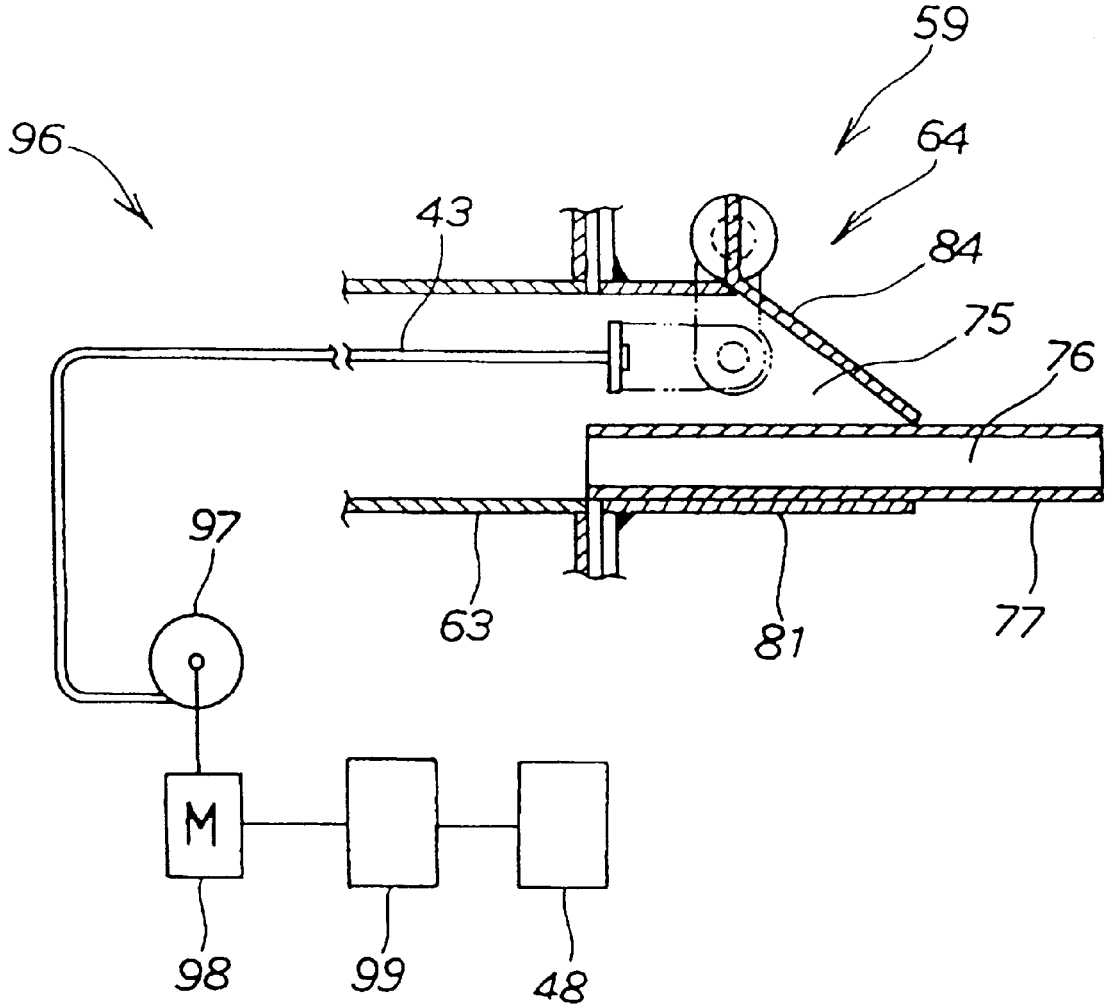
FIG. 8 is a schematic drawing of drive means of a separate embodiment to the engine exhaust assemblies of the first and second embodiments of the present invention.

FIG. 8 is a schematic drawing of drive means of a separate embodiment to the engine exhaust assemblies of the first and second embodiments of the present invention, and shows drive means 96. Parts that are the same as the drive means 41 of the first embodiment have the same reference numerals and detailed description will therefore be omitted.

Compared to the case where the drive means 41 shown in FIG. 2 uses a mechanical drive source, making use of the negative pressure of the throttle valve chamber 24*a*, the drive means 96 uses an electrical drive source and has a connecting member 43 linked to the valve mechanism wound around a pulley 97, a motor 98 for driving the pulley 97, and a controller 99 for controlling the motor 98 using information from a spark unit (ignition coil) 48.

Specifically, the drive means 96 is capable of fine control of the valve mechanism 64 according to the speed of rotation of the engine, because the valve mechanism 64 is driven by the motor 98 and the motor is controlled by a controller 99.

In the embodiments, description has been given for a motorcycle exhaust assembly, but the present invention is not particularly limited to a motorcycle exhaust assembly and can also apply to an engine exhaust assembly.

The connecting member 43 shown in the accompanying drawings can be a wire, a rod, a cable or a wire spring, etc., or any combination of these.

As shown in FIG. 2 and FIG. 7, as a member extending out from the vehicle frame 2, a step holder stay 26 is shown in the first embodiment and a muffler stay 28 is shown in the second embodiment. However, this member is not limited to these components, and any member that extends outward from the vehicle frame 2 can be used.

With the above described structure, the present invention enables the following effects.

In the first embodiment, for example, when the engine is rotating at low revs, the valve mechanism is closed, so that exhaust gas is discharged from the exhaust passageway without the valve mechanism. However, when the engine is rotating at high revs the valve mechanism is open so exhaust gas is discharged simultaneously from the exhaust passageway without the valve mechanism and the exhaust passageway provided with the valve mechanism. Therefore, exhaust noise when the engine is rotating at low revs can be reduced.

Also, by dividing one connecting pipe with a partitioning member and providing a valve mechanism in one of the exhaust passageways formed by the dividing member, the structure of the exhaust assembly can be simplified.

In the second embodiment, the valve mechanism is fitted into the connecting pipe of the silencer, one end of a connecting member is connected to this valve mechanism, and the other end of the connecting member is connected to drive means arranged outside the silencer. When the valve mechanism is driven by the drive means, since a pipe is fitted to the silencer and part of the connecting member is housed in the pipe, the connecting member can be hidden from the outside of the silencer and the external appearance of the exhaust assembly can be improved.

In the above embodiments, in a motorcycle exhaust assembly having an engine arranged substantially in the center of a vehicle frame of the motorcycle, with an exhaust pipe extending rearwards from the engine, a silencer connected to the exhaust pipe and a valve mechanism for varying the exhaust flow amount being provided in a connection pipe of the silencer, the valve mechanism being connected to drive means provided on the side of a vehicle frame via a connecting member, the connecting member is close to the silencer, and is caused to run alongside a member extending out from the vehicle frame, so that it reaches the side of the vehicle frame, which means that, for example, a member for supporting the connecting member can be omitted. Specifically, the number of components of the motorcycle exhaust system can be reduced, bringing about cost reduction as well as making it possible to reduce the weight of the motorcycle.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An engine exhaust assembly comprising:

a valve mechanism for varying opening areas of a connecting pipe of a silencer arranged in the engine exhaust assembly;

a connecting member passing through the silencer, said connecting member having a one end connected to the valve mechanism another end of the connecting member connectable to drive means arranged outside the silencer to allow the valve mechanism to be driven by the drive means; and wherein the pipe of the silencer includes a connecting pipe and a joint pipe attached to an end of the connecting pipe, and a partitioning member attached to the joint pipe, said valve mechanism being attached to the joint pipe.

2. The engine exhaust assembly according to claim 1, further comprising:

a diaphragm located between the drive means and the connecting member; said drive means connectable to a throttle valve chamber of a carburetor through a bypass controller and a check valve; and wherein the drive means drives the diaphragm by applying negative pressure from the throttle valve chamber thereto, said bypass controller controls the amount of negative pressure applied from the throttle valve chamber, and said check valve sets the amount of negative pressure to be applied from the throttle valve chamber within a predetermined range.

3. The engine exhaust assembly according to claim 1, wherein said valve mechanism includes a support platform attached to the joint pipe, a shaft member rotatably attached to the support platform, a lever for connecting to a connecting holder attached to one end of the shaft member, an opening and closing member attached to a central section of the shaft member, and a return unit for returning the opening and closing member to an initial state attached to another end of the shaft member.

4. The engine exhaust assembly according to claim 1, said drive means further comprising:

a pulley, said connecting member being wound around the pulley;

a motor for driving the pulley; and a controller for controlling the motor, wherein the valve mechanism is controlled to vary the surface area of said one of the exhaust passages.

5. A motorcycle exhaust assembly comprising:

an engine arranged substantially in a center of a vehicle frame of the motorcycle;

an exhaust pipe extending rearwards from the engine;

a silencer connected to the exhaust pipe;

a valve mechanism provided in a connection pipe of the silencer;

a connecting member, one end of said connecting member being connected to the valve assembly, the other end of the connecting member being connected to drive means provided on a side of a vehicle frame, and the valve mechanism being driven by the drive means; and wherein a central portion of the connecting member is located close to the silencer, said connecting member extending alongside a member extending out from the vehicle frame.

6. The motorcycle exhaust assembly according to claim 5, wherein said member is a muffler stay.

7. The motorcycle exhaust assembly according to claim 5, wherein said member is a step holder stay.

8. An engine exhaust assembly, comprising:

a valve mechanism for varying opening areas of a connecting pipe of a silencer arranged in the engine exhaust assembly, said valve mechanism closing an exhaust passage in a low revolution operating state;

a connecting member passing through the silencer, said connecting member having a one end connectable to the valve mechanism and another end of the connecting member connectable to drive means arranged outside the silencer to allow the drive means to drive the valve mechanism; and wherein said drive means further comprises a pulley, said connecting member being wound around the pulley;

a motor for driving the pulley; and a controller for controlling the motor, wherein the valve mechanism is controlled to vary the surface area of an exhaust passage between a closed position and a open position.

* * * * *